US006869498B1

(12) United States Patent
Tsai et al.

(10) Patent No.: US 6,869,498 B1
(45) Date of Patent: Mar. 22, 2005

(54) CHEMICAL MECHANICAL POLISHING WITH SHEAR FORCE MEASUREMENT

(75) Inventors: Stan Tsai, Fremont, CA (US); Rashid Mavliev, Campbell, CA (US); Liang-Yuh Chen, Foster City, CA (US)

(73) Assignee: Applied Materials, Inc., Santa Clara, CA (US)

( * ) Notice: Subject to any disclaimer, the term of this patent is extended or adjusted under 35 U.S.C. 154(b) by 124 days.

(21) Appl. No.: 10/358,780

(22) Filed: Feb. 4, 2003

Related U.S. Application Data

(60) Provisional application No. 60/354,726, filed on Feb. 4, 2002.

(51) Int. Cl.[7] ..... H01L 21/304

(52) U.S. Cl. ..... 156/345.13; 156/345.12; 156/345.15; 156/345.24

(58) Field of Search ..... 156/345.12, 345.13, 156/345.15, 345.24

(56) References Cited

U.S. PATENT DOCUMENTS 5,036,015 A 7/1991 Sandhu et al.
5,069,002 A 12/1991 Sandhu et al.
5,081,051 A 1/1992 Mattingly et al.
5,456,627 A 10/1995 Jackson et al.
5,720,845 A * 2/1998 Liu ..... 156/345.13
5,743,784 A 4/1998 Birang et al.
6,046,111 A * 4/2000 Robinson ..... 438/693
6,242,353 B1 * 6/2001 Kobayashi et al. ..... 438/692
6,283,829 B1 * 9/2001 Molnar ..... 451/8
6,458,013 B1 * 10/2002 Saka et al. ..... 451/5
6,464,824 B1 * 10/2002 Hofmann et al. ..... 156/345.16
6,492,273 B1 * 12/2002 Hofmann et al. ..... 438/692
6,551,933 B1 * 4/2003 Molnar ..... 438/690

* cited by examiner

*Primary Examiner*—Jeffrie R. Lund
(74) *Attorney, Agent, or Firm*—Fish & Richardson

(57) ABSTRACT

A chemical mechanical polishing system uses a shear force measurement system. Polishing parameters, such as the polishing pressure, can be adjusted in response to the measured shear force. For example, the pressure can be increased to avoid hydroplaning or decreased to avoid delamination or damage to a low-k dielectric film being polished. The shear force measurement system can include a sensor disk and one or more load cells.

16 Claims, 2 Drawing Sheets

CHEMICAL MECHANICAL POLISHING WITH SHEAR FORCE MEASUREMENT

CROSS-REFERENCE TO RELATED APPLICATIONS

This application claims priority to U.S. Provisional Application Ser. No. 60/354,726, filed on Feb. 4, 2002.

BACKGROUND

This invention relates to methods and apparatus for monitoring the shear force on a substrate during chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can-be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

As noted, the polishing pad initially has a rough surface. However, after a period of polishing the surface features on the pad are blunted, the polishing pad surface can become "glazed". This reduces the coefficient of friction between the polishing pad and substrate, thereby reducing the material removal rate. Accordingly, the polishing pad is periodically conditioned to restore its rough surface texture and ensure a repeatable material removal rate. Customarily, the polishing pad is conditioned after processing each substrate.

SUMMARY

In one aspect, the invention is directed to a method of chemical mechanical polishing. In the method, a substrate is placed in contact with a polishing surface in a polishing machine, a polishing liquid is supplied to the polishing surface, and relative motion is caused between the polishing surface and the substrate. A shear force generated by the polishing surface is measured, and a polishing parameter of the polishing machine is adjusted in response to the measured shear force.

Implementations of the invention may include one or more of the following features. A sensor disk may be placed in contact with the polishing surface, and a shear force may be measured on the sensor disk, e.g., by measuring a lateral force on a load cell. The adjusting step may include detecting hydroplaning by the substrate, e.g., by sensing that the shear force decreases suddenly. A polishing pressure may be increased if the substrate begins to undergo hydroplaning. A polishing pressure may be decreased if the shear force exceeds a threshold. The threshold may represent an experimentally determined shear force above which damage to the substrate can occur. The substrate may include a low-k dielectric film that contacts the polishing surface.

In another aspect, the invention is directed to a method of chemical mechanical polishing in which a substrate is held in contact with a polishing surface in a polishing machine at a pressure, a polishing liquid is supplied to the polishing surface, relative motion is created between the polishing surface and the substrate, and whether the substrate is undergoing hydroplaning is detected. If the substrate is undergoing hydroplaning, a polishing parameter is adjusted to halt the hydroplaning.

Implementations of the invention may include one or more of the following features. Detecting whether the substrate is undergoing hydroplaning may include monitoring a shear force generated by the polishing surface and detecting a sudden drop in the shear force, or monitoring a coefficient of friction of the polishing surface against a material and determining whether the coefficient of friction is less than a predetermined threshold. Adjusting the polishing parameter may include decreasing the pressure of the substrate on the polishing surface or decreasing the relative motion between the substrate and the polishing surface.

In another aspect, the invention is directed to a method of chemical mechanical polishing in which a low-k dielectric layer of a substrate is held in contact with a polishing surface in a polishing machine at a pressure, a polishing liquid is supplied to the polishing surface, relative motion is created between the polishing surface and the substrate, whether a shear force on the low-k dielectric layer exceeds a threshold indicating a danger of delamination is determined, and the pressure is reduced if the shear force exceeds the threshold.

In another aspect, the invention is directed to a method of chemical mechanical polishing. In the method, an exposed copper layer of a substrate contacts a polishing surface, a polishing liquid is supplied to the polishing surface, and relative motion is caused between the substrate and the polishing surface. A cleaning fluid is sprayed onto the polishing surface during polishing to remove polishing by-products from the polishing surface so as to maintain a substantially constant shear force on the substrate.

In another aspect, the invention is directed to an apparatus for measuring a shear force generated in a chemical mechanical polishing system. The apparatus includes a sensor disk, a housing having a flange to retain the sensor disk, and a load cell positioned such that lateral motion of the sensor disk causes the sensor disk to contact the load cells.

Implementations of the invention may include one or more of the following features. The apparatus may have a plurality of load cells. The housing may be secured at the end of a movable arm. A controllable pressure mechanism may apply a force to press the sensor disk against the polishing pad.

In another aspect, the invention is directed to a chemical mechanical polishing apparatus that has a polishing surface, a carrier head to hold a substrate against the polishing surface at a pressure, a port to supply a polishing liquid to the polishing surface, a motor coupled to at least one of the carrier head and the polishing surface to create relative motion between the polishing surface and the substrate, a monitor to measure at least one of a shear force or coefficient of friction of the polishing surface, and a controller configured to determine whether the substrate is undergoing hydroplaning, and to adjust a polishing parameter to halt the hydroplaning if the substrate is undergoing hydroplaning.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A potential problem in chemical mechanical polishing is uncertainty in the polishing rate. Since the surface roughness of the polishing pad can vary, the polishing rate can also vary. Thus, it would be useful to be able to ascertain the surface roughness of the polishing pad and use this information to adjust other polishing parameters to ensure a consistent polishing rate.

Another potential problem occurs in the chemical mechanical polishing of low-k dielectric film. As integrated circuit geometry shrinks below 0.1 microns, the expected industry standard is to replace conventional $SiO_2$ dielectrics with low-k films (films with dielectric constant lower than that of $SiO_2$. i.e., $k<3.5$ or more preferably $k<3.0$). It is believed that some low-k dielectrics have a reduced mechanical strength and lower adhesion energy to underlying layers. Consequently, these low-k dielectric films may be subject to delamination or damage when subjected to large shear forces. Without being limited to any particularly theory, the porous nature of and/or organic components in the low-k dielectrics may contribute to their reduced mechanical strength and lower adhesion energy.

Figure 1:
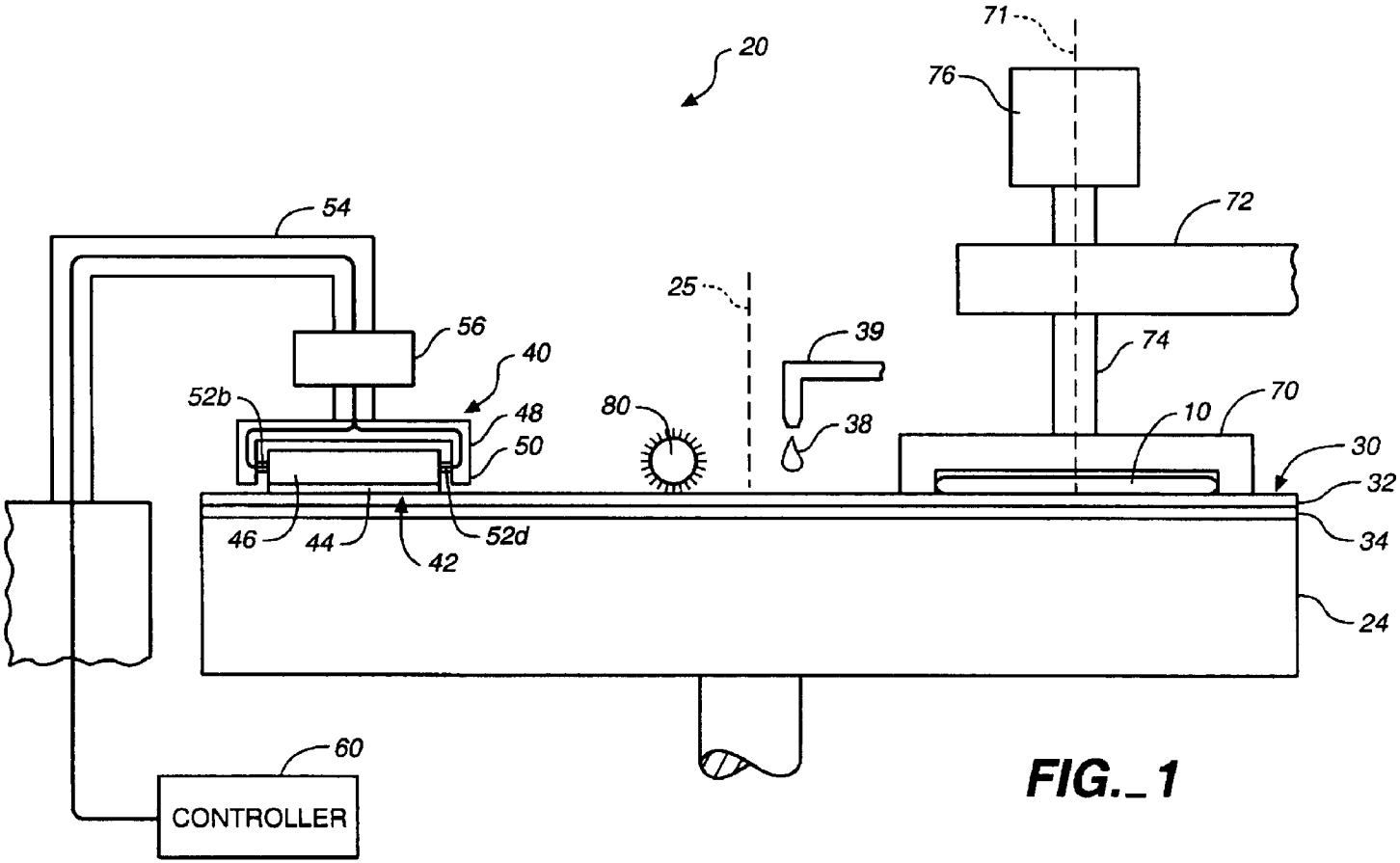
FIG. 1 is a schematic side view, partially cross-sectional, of a chemical mechanical polishing station that includes a shear force monitoring system.
Figure 2:
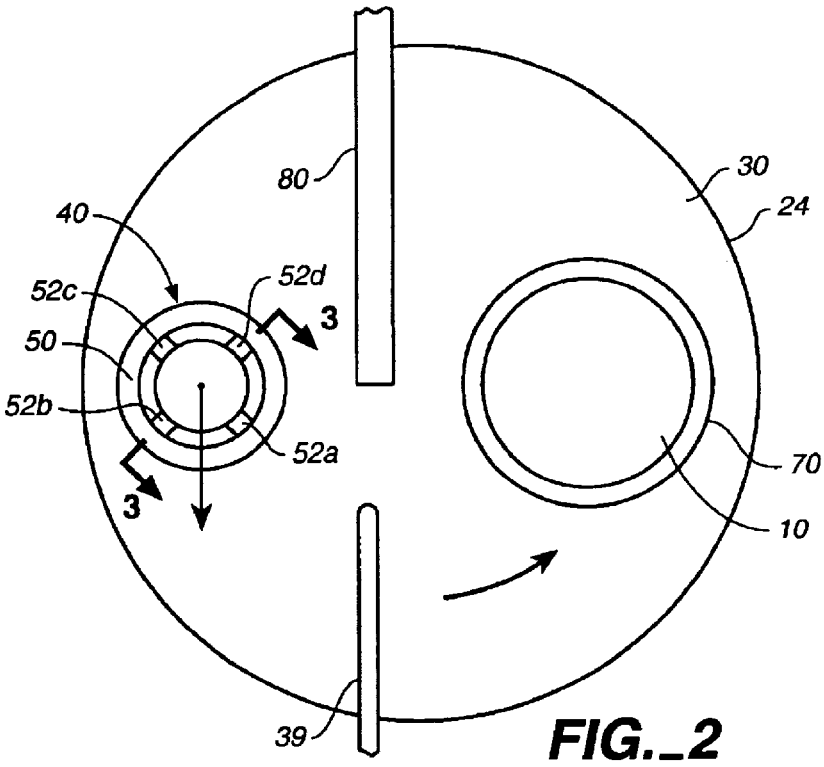
FIG. 2 is a schematic top view of the polishing station of FIG. 1.

Referring to FIGS. 1 and 2, one or more substrates 10 can be polished by a CMP apparatus 20. A description of a suitable polishing apparatus 20 can be found in U.S. Pat. No. 5,738,574, the entire disclosure of which is incorporated herein by reference.

The polishing apparatus 20 includes a rotatable platen 24 on which is placed a polishing pad 30. The polishing pad 30 can be a two-layer polishing pad with a hard durable rough outer layer 32 and a soft backing layer 34. The polishing station can also include a pad conditioner apparatus to maintain the condition of the polishing pad so that it will effectively polish substrates.

During a polishing step, a slurry 38 containing a liquid and a pH adjuster can be supplied to the surface of polishing pad 30 by a slurry supply port or combined slurry/rinse arm 39. The slurry 38 can also include abrasive particles.

The substrate 10 is held against the polishing pad 30 by a carrier head 70. The carrier head 70 is suspended from a support structure 72, such as a carousel, and is connected by a carrier drive shaft 74 to a carrier head rotation motor 76 so that the carrier head can rotate about an axis 71. In addition, the carrier head 70 can oscillate laterally in a radial slot formed tie support structure 72. A description of a suitable carrier head 70 can be found in U.S. patent application Ser. Nos. 09/470,820 and 09/535,575, filed Dec. 23, 1999 and Mar. 27, 2000, respectively, the entire disclosures of which are incorporated by reference. In operation, the platen is rotated about its central axis 25, and the carrier head is rotated about its central axis 71 and translated laterally across the surface of the polishing pad.

The polishing apparatus 20 also includes a shear force measurement system 40 that measures the shear force from the polishing pad. The shear force measurement system 40 can also be used to determine the coefficient of friction between the surface of the polishing pad 30 and the substrate 10. A system for measuring the frictional coefficient of a polishing pad is also described in U.S. Pat. No. 5,743,784, the entirety of which is incorporated by reference.

Figure 3:
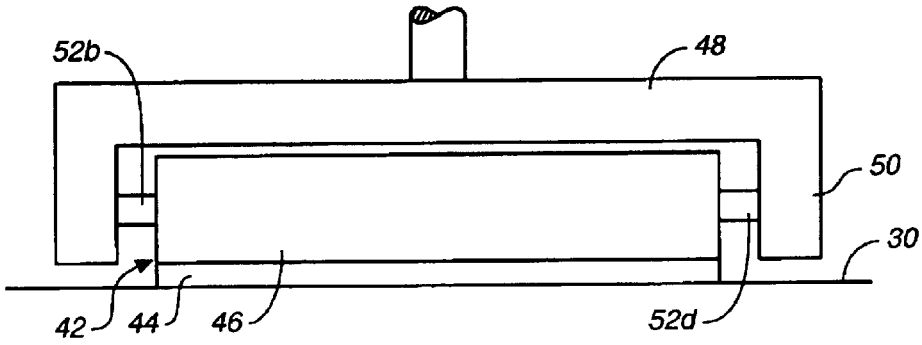
FIG. 3 is an enlarged view of FIG. 1 illustrating the shear force monitoring system.

Referring to FIGS. 2 and 3, the shear force measurement system 40 includes a sensor disk 42 that is retained on the polishing pad by a housing 48. The sensor disk 42 includes a load plate 46 and a contact plate 44 secured, e.g., with an adhesive, to the bottom of the load plate 46. The contact plate 44 abuts the polishing pad 30. The sensor disk 42 is not laterally secured to the housing 48, but is free to move under frictional forces from the polishing pad 30. The load plate 46 provides most of the physical size and mass of the sensor disk 42. The load plate 46 can be formed of aluminum, whereas the contact plate 44 can be formed of the same or similar material that is being polished. For example, the contact plate 44 can be copper, tantalum, tantalum nitride, silicon oxide, or a low-k dielectric material. In general, the material of the contact plate 44 can be an insulator, a conductor or a barrier layer.

The housing 48 is a generally circular structure with an annular retaining flange 50. The retaining flange 50 is used to hold the sensor disk 42 below the housing 48 when the polishing pad is rotating. However, the retaining flange 50 does not extend so far downwardly that it contacts the polishing pad 30. In this way, at least part of the contact plate 44 extends beyond the flange 50 to contact the polishing pad 30.

Four load cells **52*a*-52*d* are attached to the interior surface of the retaining flange 50. The load cells 52*a*-52*d* are positioned such that lateral motion of the sensor disk 42 carries the sensor disk 42** into contact with one or two of the load cells. The load cells can be any appropriate commercially available sensor that produces a signal indicative of the force exerted thereon.

Two load cells **52*a* and 52*b* can be located about ninety degrees apart, and can be positioned such that the expected velocity vector on the substrate bisects the angle between the load cells 52*a* and 52*b*. This can improve the likelihood that both cells 52*a* and 52*b*** produce a strong, low noise signal.

Returning to FIG. 1, the housing 48 is located at the end of a translation arm 54 that can sweep the measuring sensor across the polishing pad. In addition, a pressure mechanism 56, such as a pneumatic cylinder or an inflatable bladder, can be located between the translation arm and the housing 48 in order to apply a controllable downward load to the sensor disk 42. In fact, the housing 48 and sensor disk 42 of the shear force measurement system 40 can attached to the bottom of a conditioning head, such as the conditioner system described in U.S. Pat. No. 5,743,784, the entire disclosure of which is incorporated by reference. By forcing fluid into the chamber in the conditioner head, the sensor disk 42 is pressed against the polishing pad 30 with a controllable load.

During polishing or conditioning, each load cell **52*a*-52*d* will sense a force and provide a signal indicative of the second forces. In general, assuming that the sensor disk 42 is driven by the frictional forces of the polishing pad against two of the load cells, e.g., cells 52*a* and 52*b***, then the resultant total shear force $F_{shear}$ on the sensor disk can be calculated as $$F_{shear}=F_A^2+F_B^2 \quad (1)$$

where $F_A$ and $F_B$ are the forces measured by the load cells **52*a* and 52*b*, respectively. A processor in a controller 60, such as a general purpose programmable digital computer, can be used to calculate this resultant force. The controller 60** may include software, i.e., instructions tangibly stored in a computer-readable media, such as a magnetic disk or a memory, to cause the polishing system to perform the various methods discussed herein.

The magnitude of the resultant force is tied to the coefficient of friction between the polishing pad and the sensor disk and the downward pressure on the sensor disk 52. Specifically, the relationship between the coefficient of friction ($\mu$), the downward force ($F_{down}$) and the shear force will essentially be given by the following equation:

$$F_{shear}=\mu F_{down} \quad (2)$$

The load cells 52*a*-52*d* are calibrated to a known weight, and the sensor disk 42 is pressed against the polishing pad with a controllable load. Thus, the average coefficient of friction can be calculated from the measured shear force:

$$\mu=W_{measured}/W_{load} \quad (3)$$

However, a more accurate measurement of the coefficient of friction can be obtained by measuring the shear force at different down load values and creating a linear fit for the data. The resulting slope can be taken as the coefficient of friction, and excludes the effects of any offsets from apparatus.

Using the measured coefficient of friction and the known down-force on the substrate, the total shear force on the substrate surface can be calculated.

The coefficient of friction between a new polishing pad and a semiconductor wafer is typically about 0.4–0.5, although it may be significantly different for newer materials such as copper or low-k dielectrics.

As the relative linear velocity between the substrate and polishing surface increase, the coefficient of friction tends to decrease. In addition, at very high velocities and low substrate pressures, the coefficient of friction and the shear force drop to an extremely low level and is generally uncorrelated with the down-force. Without being limited to any particular theory, it is believed that this phenomenon is cause by hydroplaning of the substrate on the slurry. The onset of hydroplaning depends on the slurry, substrate and pad composition. When hydroplaning occurs, the polishing rate drops precipitously. By measuring the shear force or coefficient of friction during a development phase, the onset of hydroplaning can be detected. Polishing parameters, such as pressure, rotation rate and polishing slurry, can be selected for polishing of product substrates in order to avoid hydroplaning. In addition, the shear force and coefficient of friction could be measured in-situ.

If the controller 60 detects a sudden drop in the shear force or coefficient of friction, indicating the onset of hydroplaning, the controller 60 can compensate, e.g., by increasing the pressure until the hydroplaning effect ceases. Alternatively, the controller could compensate by decreasing the platen rotation rate so as to reduce the relative speed between the substrate and polishing surface. The controller can determine that the hydroplaning effect has ceased from either a sudden increase in the shear force or coefficient of friction.

The controller could also compare the measured coefficient of friction to an experimentally determined threshold to determine whether hydroplaning is occurring. If the coefficient is below the threshold, the controller determines that the substrate is undergoing hydroplaning.

An in-situ shear force monitor could also be used to prevent delamination or damage to low-k dielectric films. The shear force at which a particular film material is damaged can be determined experimentally. When the in-situ shear force monitor determines that the shear force is excessive, the controller 60 can compensate, e.g., by decreasing the pressure, to reduce the likelihood of delamination or damage to the film. For example, the controller 60 can decrease the pressure if the shear force exceeds an experimentally determined threshold value.

A potential problem, particularly for the polishing of copper, is non-uniform shear forces during the polishing of a single substrate. Without being limited to any particular theory, it is believed that polishing by-products of copper polishing accumulate on the polishing pad, causing the shear force to increase as polishing progresses on the substrate. If the polishing rate is high, the polishing by-products can accumulate quickly, thereby rapidly changing the shear force. A change in the shear force can affect the polishing rate. Consequently, frequent and in-situ cleaning of the polishing pad to remove the polishing byproducts may be beneficial to achieve a consistent shear force and a consistent polishing rate. For example, a cleaning mechanism 80, such as vacuum, brush or pressing rod, can extend along a radius of the polishing pad. During polishing, the cleaning mechanism 80 vacuums, brushes, scrubs or urges the polishing by-products off the polishing pad. In general, a cleaning fluid is not used, as this represents a danger of diluting the polishing fluid. However, in some implementations or some processes a cleaning fluid can be sprayed onto the polishing pad to wash the polishing by-products off the polishing pad.

A number of embodiments of the invention have been described. Nevertheless, it will be understood that various modifications may be made without departing from the spirit and scope of the invention. Accordingly, other embodiments are within the scope of the following claims.

What is claimed is:

1. An apparatus for measuring a shear force generated in a chemical mechanical polishing system, comprising:

a sensor disk configured to contact a polishing surface;

a housing having a flange to retain the sensor disk; and a load cell positioned such that lateral motion of the sensor disk causes the sensor disk to contact the load cell.

2. The apparatus of claim 1, further comprising a plurality of load cells.

3. The apparatus of claim 1, further comprising a movable arm, and wherein the housing is secured at the end of the arm.

4. The apparatus of claim 1, further comprising a controllable pressure mechanism that applies a force to press the sensor disk against the polishing surface.

5. The apparatus of claim 1, further comprising:

a monitor configured to measure a force exerted on the load cell and to estimate a shear force between the sensor disk and the polishing surface.

6. The apparatus of claim 5, further comprising:

a controller configured to signal, when the estimated shear force exceeds a threshold, for a carrier head to reduce a pressure on a substrate.

7. The apparatus of claim 5, further comprising:

a controller configured to signal, when the estimated shear force exceeds a threshold, for a cleaning mechanism to clean the polishing surface.

8. The apparatus of claim 1, wherein the sensor disk includes a lower portion formed of one of copper, tantalum, tantalum nitride, silicon oxide or a low-k dielectric material.

9. A chemical mechanical polishing apparatus, comprising:

a polishing surface;

a carrier head to hold a substrate against the polishing surface at a pressure;

a port to supply a polishing liquid to the polishing surface;

a motor coupled to at least one of the carrier head and the polishing surface to create relative motion between the polishing surface and the substrate;

a monitor to measure at least one of a shear force or coefficient of friction of the polishing surface, the monitor including a sensor disk configured to contact the polishing surface; and a controller configured to determine whether the substrate is undergoing hydroplaning, and to adjust a polishing parameter to halt the hydroplaning if the substrate is undergoing hydroplaning.

10. The chemical mechanical polishing apparatus of claim 9, further comprising:

a cleaning mechanism configured to remove polishing by-products from the polishing surface.

11. The chemical mechanical polishing apparatus of claim 10, wherein the controller is configured to signal, when the measured at least one of the shear force or the coefficient of friction exceeds a threshold, for the cleaning mechanism to remove the polishing by-products.

12. The chemical mechanical polishing apparatus of claim 9, wherein the controller is configured to determine that the substrate is undergoing hydroplaning if the measured at least one of the shear force or the coefficient of friction decreases suddenly.

13. The chemical mechanical polishing apparatus of claim 9, wherein the polishing parameter that the controller is configured to adjust is the pressure at which the carrier head is holding the substrate against the polishing surface.

14. The chemical mechanical polishing apparatus of claim 9, wherein the polishing parameter that the controller is configured to adjust is a speed of the relative motion between the polishing surface and the substrate.

15. The chemical mechanical polishing apparatus of claim 9, further comprising a substrate held by the carrier head, the substrate including a material to be polished, and wherein the sensor disk includes a lower portion formed of the same material.

16. The chemical polishing apparatus of claim 15, wherein the sensor disk includes a lower portion formed of one of copper, tantalum, tantalum nitride, silicon oxide or a low-k dielectric material.

* * * * *

UNITED STATES PATENT AND TRADEMARK OFFICE

CERTIFICATE OF CORRECTION

PATENT NO. : 6,869,498 B1
DATED : March 22, 2005
INVENTOR(S) : Stan D. Tsai et al.

It is certified that error appears in the above-identified patent and that said Letters Patent is hereby corrected as shown below:

Column 8,
Line 18, replace "The chemical polishing apparatus" with -- The chemical mechanical polishing apparatus --.

Signed and Sealed this

Twentieth Day of September, 2005

JON W. DUDAS
*Director of the United States Patent and Trademark Office*